US011272800B1

(12) United States Patent
Monte et al.

(10) Patent No.: US 11,272,800 B1
(45) Date of Patent: Mar. 15, 2022

(54) MAILBOX SYSTEM

(71) Applicants: Frank Monte, New Port Richey, FL (US); Deniscia Monte, New Port Richey, FL (US)

(72) Inventors: Frank Monte, New Port Richey, FL (US); Deniscia Monte, New Port Richey, FL (US)

( * ) Notice: Subject to any disclaimer, the term of this patent is extended or adjusted under 35 U.S.C. 154(b) by 145 days.

(21) Appl. No.: 16/798,333

(22) Filed: Feb. 22, 2020

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; A47G 29/1209; A47G 29/122; A47G 29/30; G09F 23/00
USPC ..... 232/17, 38, 39; 40/606.06; D99/30
See application file for complete search history.

(56) References Cited

U.S. PATENT DOCUMENTS 1,377,084 A * 5/1921 McDill ..... A47G 29/1216 248/145
1,435,379 A * 11/1922 Connery ..... A47G 29/1216 248/145
1,545,006 A * 7/1925 Miller ..... A47G 29/1216 248/128
1,955,373 A * 4/1934 Turrill ..... A47G 29/1216 248/146
4,813,595 A * 3/1989 Johns, Jr. ..... A47G 29/121 232/17
4,991,769 A * 2/1991 Todd ..... A47G 29/1209 232/17
5,000,379 A * 3/1991 LaRue ..... A47G 29/1209 232/17
5,190,214 A * 3/1993 Dewailly ..... A47G 29/1216 232/39
5,207,378 A * 5/1993 Detchon ..... G09F 1/08 232/38
5,400,959 A * 3/1995 Cone ..... A47G 29/1216 232/34
5,524,858 A * 6/1996 Friend ..... A47G 29/1216 232/39
5,946,838 A * 9/1999 Lanoue ..... G09F 7/18 40/607.14
5,984,172 A * 11/1999 Easterwood ..... G09F 27/00 232/38
6,032,808 A * 3/2000 Henson ..... A47G 29/1209 211/85.23
D428,546 S * 7/2000 Rempfer ..... D99/30
6,308,884 B1 * 10/2001 Hamburger ..... A47G 29/1216 232/38

(Continued)

*Primary Examiner* — William L Miller
(74) *Attorney, Agent, or Firm* — Gulf Coast Intellectual Property Group

(57) ABSTRACT

A mailbox system that is operable to provide an owner thereof the ability to change a portion of the mailbox system for thematic decorative purposes. The mailbox system of the present invention includes a lower portion having a base member and a mounting pole member wherein the base member is configured to be buried in the ground. The mounting pole member extends upward from the base member and is configured to operably couple with a support pole of the upper portion. The upper portion includes a body member wherein the body member further has an integrally formed receptacle. The body member is manufactured in various shapes and sizes so as to provide decorative theme options. A locking mechanism is present on the upper portion and is configured to provide securing of the upper portion to the lower portion.

10 Claims, 4 Drawing Sheets

(56) References Cited

U.S. PATENT DOCUMENTS

D467,519 S * 12/2002 Arendt ..... D11/181
6,619,541 B2 * 9/2003 Martin ..... G09F 23/00 232/38
6,726,089 B1 * 4/2004 Jones ..... A47G 29/121 232/38
6,772,938 B2 * 8/2004 Martin ..... G09F 23/00 232/38
6,929,173 B2 * 8/2005 Toussant ..... B44C 1/10 232/38
6,962,284 B1 * 11/2005 Hartelius ..... H04N 1/00204 232/38
7,261,233 B2 * 8/2007 Menghini ..... A47G 29/1216 232/38
7,316,346 B1 * 1/2008 Hartelius ..... H04N 1/00204 232/38
7,328,835 B2 * 2/2008 Menghini ..... B44C 5/00 232/38
7,587,846 B2 * 9/2009 Khan ..... G09F 7/04 232/17
D616,175 S * 5/2010 Chen ..... D99/30
7,810,708 B1 * 10/2010 Schofield ..... A01G 9/022 232/39
8,939,353 B1 * 1/2015 Blocker ..... A47G 29/121 232/34
9,402,497 B1 * 8/2016 Covert ..... E04H 12/2215
10,595,657 B1 * 3/2020 Yoder ..... A47G 29/1203
2006/0138208 A1 * 6/2006 Lackey ..... E01F 9/685 232/39
2006/0145048 A1 * 7/2006 Robinson ..... A47G 29/1216 248/533
2009/0001151 A1 * 1/2009 Wagner ..... A47G 29/1216 232/17
2015/0090717 A1 * 4/2015 Marcell ..... A47B 81/02 220/230
2017/0032719 A1 * 2/2017 Day ..... A63H 3/003
2019/0063102 A1 * 2/2019 Writesman ..... A47G 29/1216

* cited by examiner

MAILBOX SYSTEM

FIELD OF THE INVENTION

The present invention relates generally to mail receiving receptacles, more specifically but not by way of limitation, a mailbox system wherein the present invention includes a lower portion and an upper portion wherein the upper portion is releasably secured to the lower portion and wherein the upper portion includes a body member having an integrated mail receiving compartment.

BACKGROUND

Mailboxes are well known in the art. The United States Postal service has been utilizing various different types of boxes for delivery of mail and parcels for decades. Depending upon the type of residential community there are primarily two types of mailboxes. For multi-family residences such as but not limited to apartment complexes and condominiums, a centralized large mailbox having numerous receptacles is the standard installation. For most single family residences the standard installation is to have a single mailbox located proximate the street wherein the postal carrier can have access to from a vehicle so as to deliver the mail.

While the US Postal services provides regulation guidelines for installation of mailboxes and the size and height thereof, there is allowed alternative appearing styles provided the receptacle and height requirements are in compliance with postal regulations. While some neighborhoods with home owner associations have requirements for a particular type of mailbox and post appearance, other single family residences are allowed to enhance the ornamental appearance of the mailbox. It is common for owners to use decorative elements that secure to the sides of the mailbox. Additionally, some owners will build or purchase very ornate mailboxes that are often formed to resemble an animal or other structure. For the latter, the existing mailboxes are quite expensive sometimes costing thousands of dollars. Additionally, these mailboxes represent a commitment to the style chosen and due to the expense and size are most often never replaced or transported to a new address if the owner relocates.

Accordingly, there is a need for a mailbox system that facilitates the ability for a decorative theme thereof to be changed and/or altered and wherein the mailbox system is configured to provide removal of a significant portion thereof so as to be replaced with a conventional mailbox in the event an owner desires to relocate the mailbox.

SUMMARY OF THE INVENTION

It is the object of the present invention to provide a mailbox system that is configured to facilitate the exchange of a significant portion thereof wherein the mailbox system of the present invention includes a lower portion and an upper portion.

Another object of the present invention is to provide a configurable decorative mailbox operable to provide the ability to change the ornamental appearance of the mailbox wherein the lower portion of the present invention includes a base member and a mounting pole member.

A further object of the present invention is to provide a mailbox system that is configured to facilitate the exchange of a significant portion thereof wherein the base member is buried in the ground and the mounting pole member extends upward from the upper surface thereof.

An additional object of the present invention is to provide a configurable decorative mailbox operable to provide the ability to change the ornamental appearance of the mailbox wherein the mounting pole member further includes a support collar integrally formed thereon distal to the base member.

Yet a further object of the present invention is to provide a mailbox system that is configured to facilitate the exchange of a significant portion thereof wherein the upper portion is comprised of a body member and an integral mail receiving receptacle.

A further object of the present invention is to provide a configurable decorative mailbox operable to provide the ability to change the ornamental appearance of the mailbox wherein the body member is provided in various shapes, sizes and alternate ornamental appearances.

Another object of the present invention is to provide a mailbox system that is configured to facilitate the exchange of a significant portion thereof wherein the upper portion is releasably secured to the mounting pole member.

An additional object of the present invention is to provide a configurable decorative mailbox operable to provide the ability to change the ornamental appearance of the mailbox wherein the present invention further includes a locking mechanism wherein the locking mechanism is configured to secure the upper portion in place and inhibit unwanted removal thereof.

Still a further object of the present invention is to provide a mailbox system that is configured to facilitate the exchange of a significant portion thereof wherein the mounting pole member further includes a groove or alternate structure that is configured to operably couple to a portion of the locking mechanism.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

and

Figure 1:
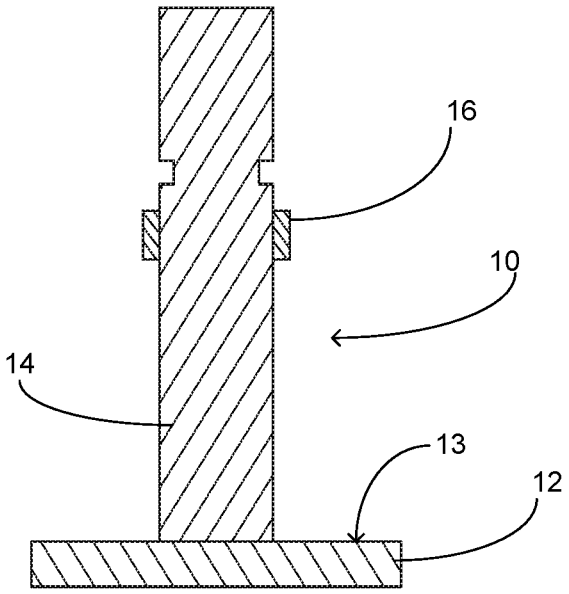
FIG. 1 is a cross-sectional of the lower portion of the present invention.
Figure 2:
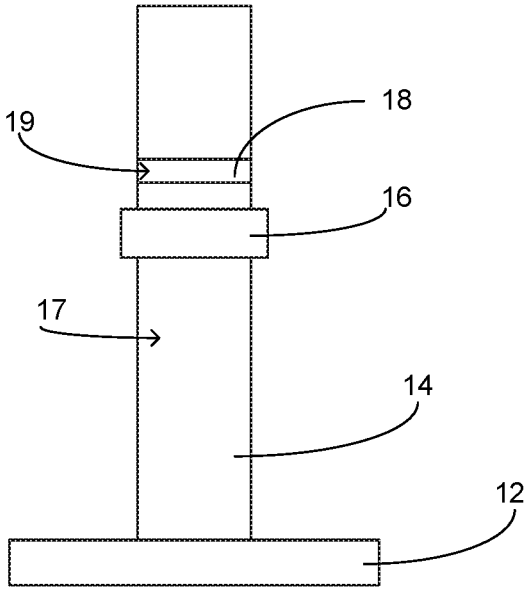
FIG. 2 is a side view of the lower portion of the present invention.
Figure 3:
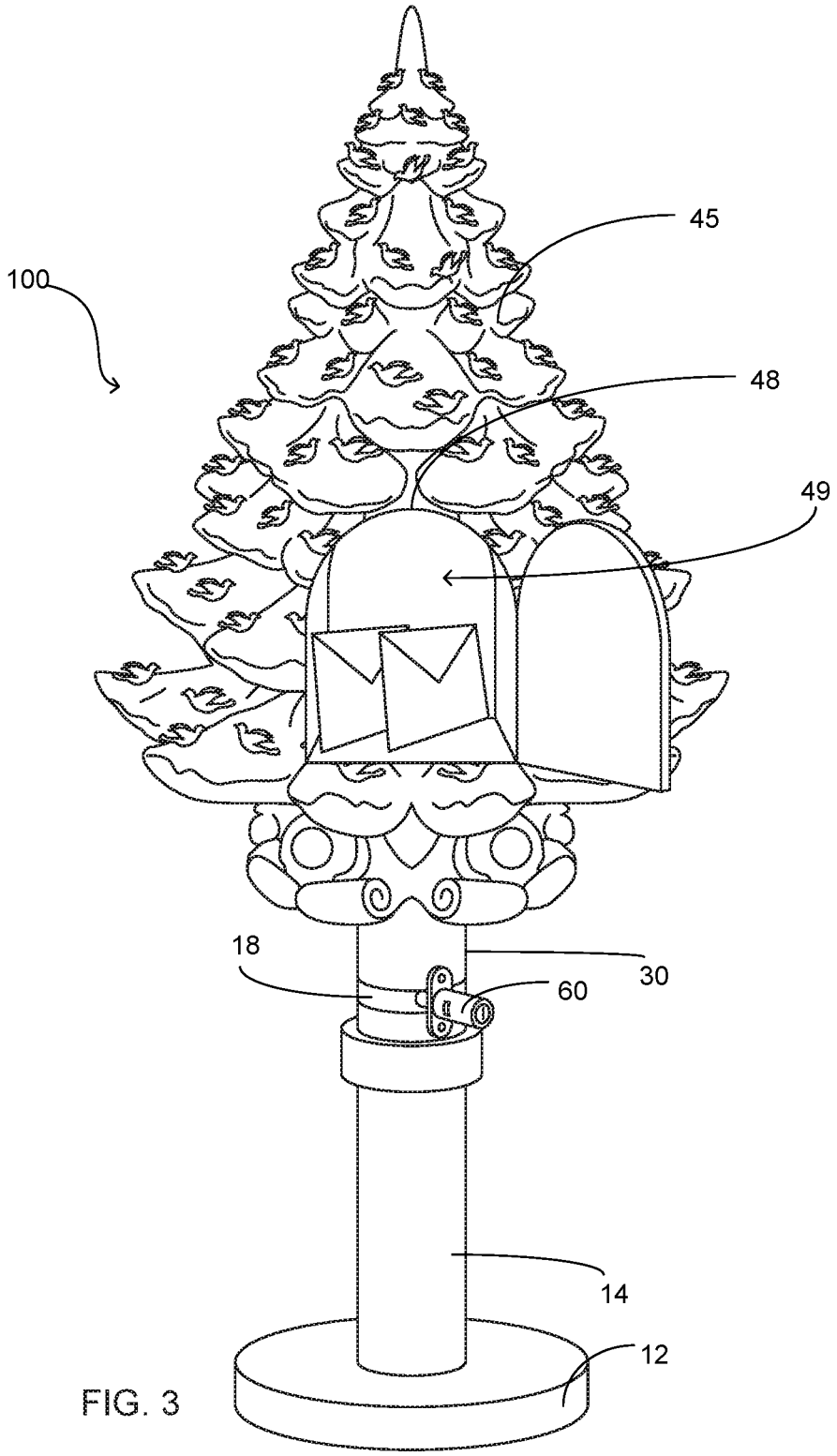

FIG. 3 is a perspective view of an embodiment of the present invention; and

Figure 4:
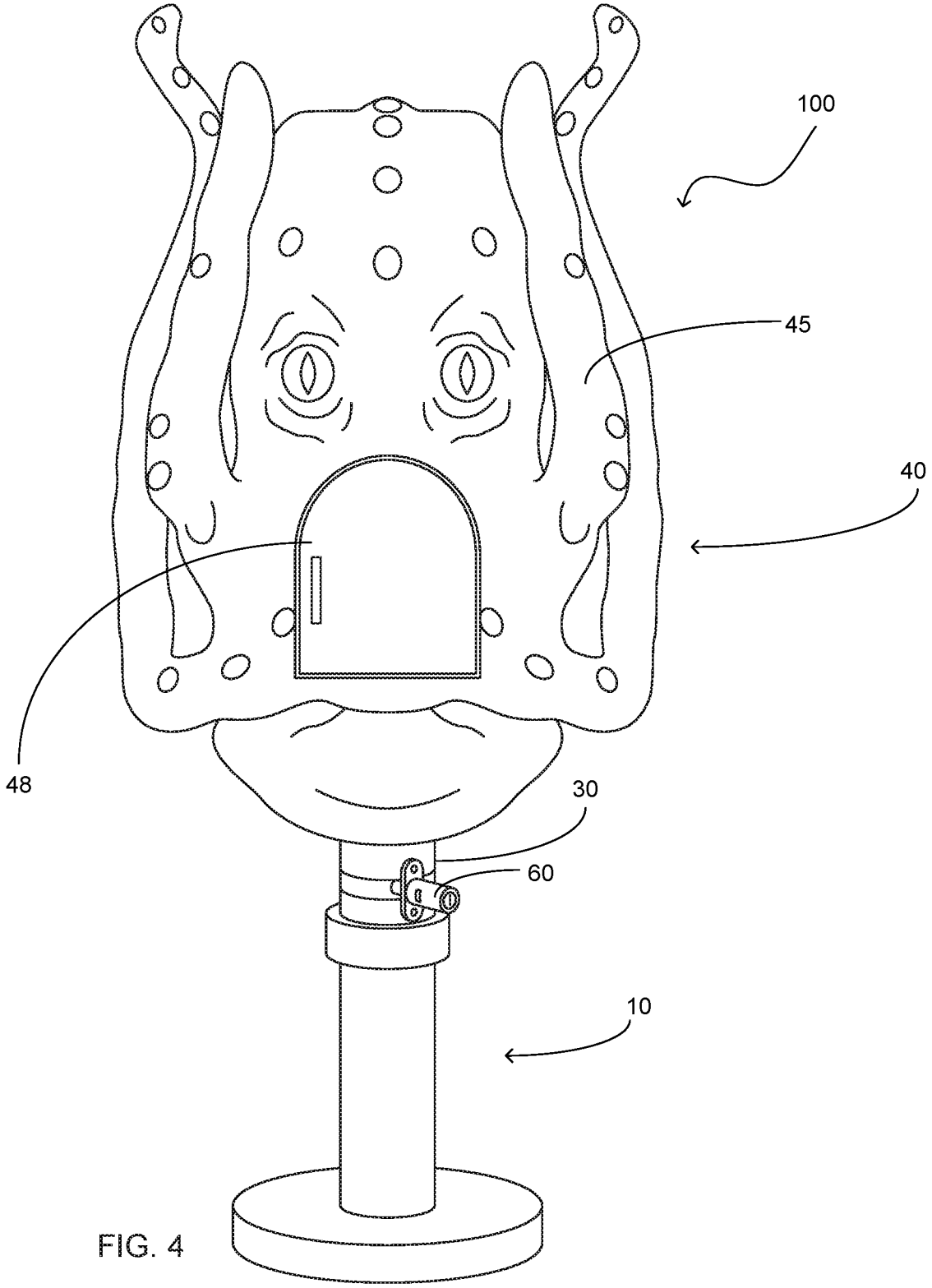
Figure 5:
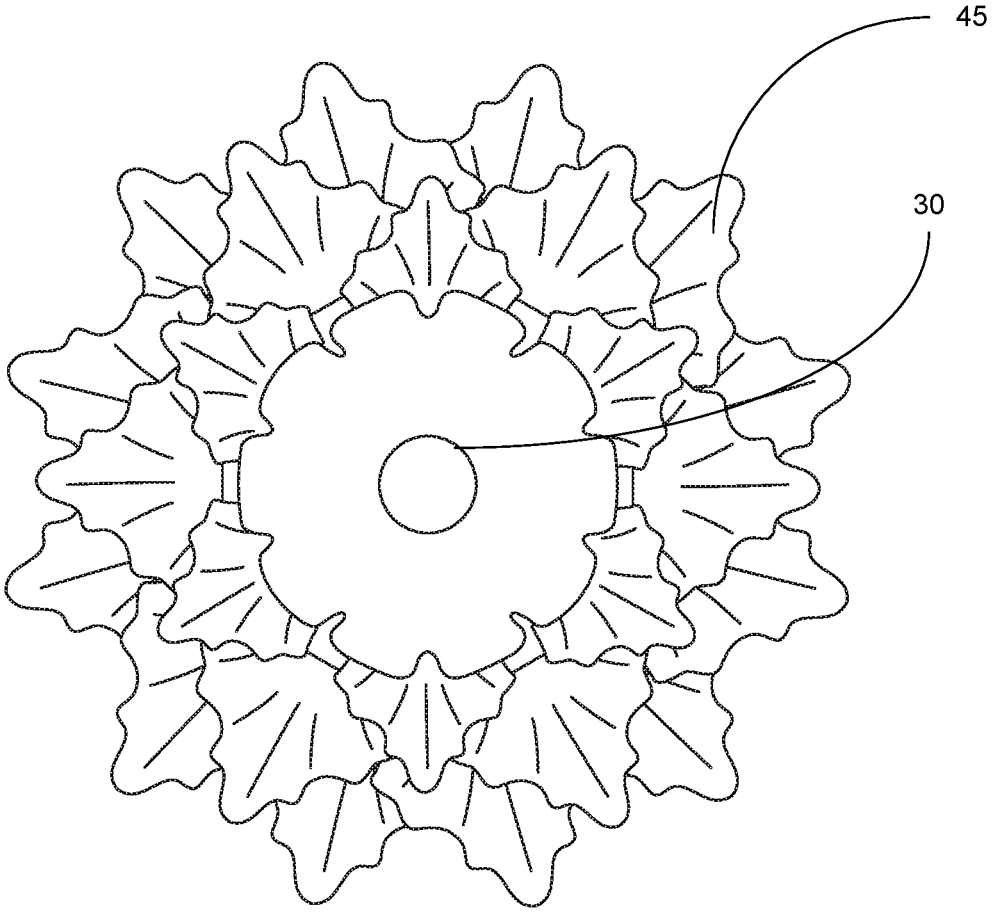

FIG. 4 is a perspective view of an alternative embodiment of the present invention; and FIG. 5 is a bottom cross sectional view of the embodiment of the present invention.

DETAILED DESCRIPTION

Referring now to the drawings submitted herewith, wherein various elements depicted therein are not necessarily drawn to scale and wherein through the views and figures like elements are referenced with identical reference numerals, there is illustrated a mailbox system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the mailbox system 100 includes a lower portion 10. The lower portion 10 is manufactured from a suitable rigid material such as but not limited to plastic. The lower portion 10 includes a base member 12 and a mounting pole member 14. The base member 12 is planar in manner and square in shape. Base member 12 is designed to be buried underground during the installation of the mailbox system 100 so as to provide stability for the mailbox system 100. It should be understood within the scope of the present invention that the base member 12 could be formed in alternate sizes and shapes and achieve the desired objective discussed herein. The mounting pole member 14 extends upward from the upper surface 13 of the base member 12 and is perpendicular thereto. The mounting pole member 14 is contiguously formed with the base member 12 utilizing suitable durable techniques. It should be understood within the scope of the present invention that the mounting pole member 14 could be formed in alternate shapes and lengths.

The mounting pole member 14 further has integrally formed thereon a support collar 16. The support collar 16 is manufactured from the same material as the mounting pole member 14 and is integrally formed thereon utilizing suitable techniques. The support collar 16 extends circumferentially around the mounting pole member 14. The support collar 16 functions to engage the pole support member 30 of the upper portion 40 in order to provide proper alignment and mounting of the upper portion 40 as is further discussed herein. While the support collar 16 is illustrated herein as completely encircling the mounting pole member 14, it is contemplated within the scope of the present invention that the support collar 16 could be structured in alternate manners wherein the support collar 16 only extend around a portion of the mounting pole member 14 or be a single stop member secured to the outer surface 17 of the mounting pole member 14. A groove 18 is formed on the outer surface 17 of the mounting pole member 14. The groove 18 includes a channel 19 that is configured to receive a portion of the locking mechanism 60 as is further discussed herein. It should be understood that the groove 18 could be formed in various widths and depths. The groove 18 is configured to encircle the mounting pole member 14 in its preferred embodiment but it is contemplated within the scope of the present invention that the groove 18 could be formed in only a portion of the outer surface 17.

The mailbox system 100 further includes a upper portion 40. The upper portion 40 includes a body member 45 and a receptacle 48. The body member 45 and receptacle 48 are integrally formed utilizing suitable durable techniques. The body member 45 is manufactured from a durable material such as but not limited to plastic. As is illustrated herein in FIG. 3 and FIG. 4, it is contemplated within the scope of the present invention that the body member 45 is manufactured in various shapes and sizes so as to resemble objects such as but not limited to marine species and holiday decorations. It is contemplated within the scope of the present invention that the body member 45 is manufactured in various sizes and shapes so as to provide decorative options for a user of the mailbox system 100. The receptacle 48 includes an interior volume 49 being of sufficient size to accommodate mail or parcels therein.

The upper portion 40 is configured to be releasably secured to the lower portion 10. The upper portion 40 includes pole support member 30 wherein the pole support member 30 extends downward from the body member 45. The pole support member 30 is configured to couple with the mounting pole member 14, in particular to slide thereover receiving the mounting pole member 14 therein. It should be understood within the scope of the present invention that the pole support member 30 is of a mateable shape and diameter so as to operably engage the mounting pole member 14. The pole support member 30 further includes a locking mechanism 60 operably coupled thereto. The locking mechanism 60 is configured to secure the upper portion 40 to the lower portion 10. In a preferred embodiment, a portion of the locking mechanism 60 penetrates into the groove 18 ensuing the upper portion 40 being operably coupled with the lower portion 10. Once placed in a locked position, the locking mechanism 60 functions inhibit the removal of the upper portion 40 from the lower portion 10. While the locking mechanism 60 is illustrated in a particular location herein, it is contemplated within the scope of the present invention that the locking mechanism 60 could be located in alternate locations and be provide in alternate styles. It is desired within the scope of the present invention that users of the mailbox system 100 have available a plurality of upper portions 40 wherein the body members 45 thereof are various styles and decors. The alternate styles and decors of the body member 45 of the upper portion 40 provides the ability for a user of the mailbox system 100 to change the upper portion 40 for circumstances such as but not limited to seasons or holidays. It is contemplated within the scope of the present invention that the mailbox system 100 could employ numerous alternate styles of locking mechanisms 60 in order to achieve the desired objective thereof discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mailbox system that provides the ability to alter the decorative theme thereof wherein the mailbox system comprises:

a lower portion, said lower portion further including a base member and a mounting pole member, said base member and said mounting pole member being integrally formed, said mounting pole member having an outer surface, wherein said base member of said lower portion is configured to be buried underground, wherein said mounting pole member further includes a groove formed in the outer surface thereof, wherein said mounting pole member further includes a support collar, said support collar operable to engage a segment of an upper portion ensuing said upper portion being operably coupled to said lower portion, said upper portion being configured to operably couple to said lower portion, said upper portion being releasably secured to said lower portion, said upper portion further including a body member, said upper portion further including a receptacle, said body member and said receptacle being integrally formed, wherein said upper portion further includes a support pole, said support pole extending downward from said body member, said support pole configured to operably couple with said mounting pole member;

a locking mechanism, said locking mechanism operable to facilitate the securing of the upper portion to the lower portion;

wherein said receptacle has an interior volume configured to receive and retain therein mail and wherein said body member is formed in alternate decorative styles and shapes.

2. A mailbox system operable to be installed in a ground surface wherein the mailbox system provides options for exchanges of a portion thereof for decorative purposes wherein the mailbox system comprises:

a lower portion, said lower portion further including a base member and a mounting pole member, said base member being planar, said mounting pole member being perpendicularly secured to said base member, said base member and said mounting pole member being integrally formed, said mounting pole member having an outer surface, wherein said mounting pole member further includes a groove, said groove being circumferentially disposed on said outer surface of said mounting pole member;

an upper portion, said upper portion being configured to operably couple to said lower portion, said upper portion having a support pole member, said upper portion being releasably secured to said lower portion, said upper portion further including a body member, said upper portion further including a receptacle, said body member and said receptacle being integrally formed; and wherein said body member is provided in alternate shapes and sizes.

3. The mailbox system as recited in claim 2, and further including a support collar, said support collar being circumferentially formed on the outer surface of the mounting pole member, said support collar configured to operably engage the support pole member of said upper portion.

4. The mailbox system as recited in claim 3, and further including a locking mechanism, said locking mechanism being positioned on said support pole member, said locking mechanism operable to secure said upper portion to said lower portion.

5. The mailbox system as recited in claim 4, wherein said receptacle further includes an interior volume operable to receive mail therein.

6. The mailbox system as recited in claim 5, wherein said support pole member and said mounting pole member are mateably shaped.

7. A mailbox system operable to be installed in a ground surface wherein the mailbox system provides options for exchanges of a portion thereof for decorative purposes wherein the mailbox system comprises:

a lower portion, said lower portion further including a base member and a mounting pole member, said base member being planar, said mounting pole member being perpendicularly secured to said base member, said base member and said mounting pole member being integrally formed, said mounting pole member having an outer surface, said mounting pole member further includes a groove, said groove being circumferentially disposed on said outer surface of said mounting pole member;

an upper portion, said upper portion being configured to operably couple to said lower portion, said upper portion having a support pole member, said upper portion being releasably secured to said lower portion, said upper portion further including a body member, said upper portion further including a receptacle, said body member and said receptacle being integrally formed;

a support collar, said support collar being circumferentially formed on the outer surface of the mounting pole member, said support collar configured to operably engage the support pole member of said upper portion ensuing said upper portion being operably engaged with said lower portion; and wherein said body member is provided in alternate shapes and sizes.

8. The mailbox system as recited in claim 7, and further including a locking mechanism, said locking mechanism operable to secure said upper portion to said lower portion subsequent operably coupling the upper portion and lower portion.

9. The mailbox system as recited in claim 8, wherein said body member of said upper portion is formed in alternate decorative styles and shapes.

10. The mailbox system as recited in claim 9, wherein said support pole member extends downward from said body member.

* * * * *